US006730891B1

(12) United States Patent
Redmon

(10) Patent No.: US 6,730,891 B1
(45) Date of Patent: May 4, 2004

(54) OVER-TEMP SAFETY DEVICE

(76) Inventor: Larry Redmon, Box 306, New Haven, IN (US) 46774

( * ) Notice: Subject to any disclaimer, the term of this patent is extended or adjusted under 35 U.S.C. 154(b) by 0 days.

(21) Appl. No.: 10/190,124

(22) Filed: Jul. 3, 2002

(51) Int. Cl.[7] ..... H05B 1/02
(52) U.S. Cl. ..... 219/510; 219/413; 219/517
(58) Field of Search ..... 219/413, 507, 219/509, 510, 511, 512, 513, 516, 517; 116/102, 217, 218; 374/159, 205, 208

(56) References Cited

U.S. PATENT DOCUMENTS 3,452,706 A * 7/1969 Vogt ..... 116/102
3,652,195 A 3/1972 McIntosh et al.
4,089,632 A 5/1978 Rexroad
4,818,119 A * 4/1989 Busch et al. ..... 374/208
5,125,068 A 6/1992 McNair et al.
5,261,598 A 11/1993 Shirayanagi et al.
5,586,719 A 12/1996 Katchka
5,685,481 A 11/1997 Murphy et al.
5,794,520 A 8/1998 Hefford

* cited by examiner

*Primary Examiner*—Tu Ba Hoang
(74) *Attorney, Agent, or Firm*—Krieg DeVault Lundy LLP

(57) ABSTRACT

An over-temperature safety device is provided. A slug of material fusible at a selected critical temperature is positioned on a heat conductive surface. A bolt is positioned through a hole in the slug. The bolt has a head which is smaller than the bolt hole. A plate overlays the heat conductive surface with the slug therebetween. The plate has a hole through which the bolt head may pass. The plate hole, bolt and slug hole are coaxial. A compression spring urges the plate and the conductive surface together with less pressure than required to cause the slug to flow at temperatures below the critical temperature. The bolt is connected to a switch by an extension spring urging the bolt to pass through the holes in the plate and slug. When the slug melts, the bolt passes through the holes in the plate and the slug and opens the switch.

18 Claims, 2 Drawing Sheets

OVER-TEMP SAFETY DEVICE

BACKGROUND OF THE INVENTION

This invention relates to over-temp safety devices, and more particularly to an overtemp safety device that is not subject to circuit defaults, creep, or the usual inaccuracies associated with mechanical devices.

Over-temp devices are used in a number of different appliances. Almost every water heater has such a device. Almost every furnace has such a device. Additionally, almost every electrical appliance with heating elements therein has an over-temp safety device. It is therefore highly desirable to provide a new and improved over-temp safety device.

Some of the prior proposed over-temp safety devices utilize bi-metal controls such as the thermostats conventionally used with internal combustion engines. These bi-metal controls not only are inaccurate, but age over time to become totally inoperable. It is therefore highly desirable to provide a new and improved over-temp safety device that does not age or become inoperative over time at temperatures below the desired temperature (hereinafter "critical temperature") above which operating temperatures should not exceed.

Fusible metal devices have also been widely used. Fusible metal solder elements have been utilized as part of an electrical circuit as a safety device. The circuit opens when the fusible metal melts at the critical temperature. However, fusible metal has been well known to lose its adhesion properties with other metals and therefore, at times, these circuits will open when not intended.

Fusible metal links many times are spring loaded or weight loaded to ensure that the fusible metal link fails when the critical temperature is reached. However, fusible metal is also known to creep at temperatures less than the desired temperature and thus fail when not intended.

Further, when fusible metal elements are part of an electrical circuit, at times, the heat generated by electrical current passing through the fusible metal will cause the device to fail, not because the device has been presented with a temperature above the critical temperature, but only because of the current and resistance of the device has heated the device.

Still further, when a fusible device is part of circuit, in order for the fusible device to work as intended, it must not only release, but disconnect. In some structures the device has released, but because of where the melted metal flows, the electrical circuit has not disconnected.

Thus, it is therefore highly desirable to provide a new and improved over-temp safety device that both releases as intended and also disconnects. It is also highly desirable to provide a new and improved over-temp safety device that will not creep and fail at temperatures below the critical temperature. It is also highly desirable to provide a new and improved over-temp safety device that is not part of an electrical circuit. It is also highly desirable to provide a new and improved over-temp safety device that is not dependent upon the adherence of fusible metal or the physical properties of the fusible metal or its electrical conductivity or resistance.

Solid state electronic devices such as thermistors have also been used in overload devices. However, these devices are also subject to failure over time in the presence of temperatures lower than the critical temperature or aging. It is therefore highly desirable to provide a new and improved over-temp safety device that does not utilize solid state electronic devices. It is also highly desirable to provide a new and improved over-temp safety device that is totally mechanical in nature. It is also highly desirable to provide a new and improved over-temp safety device that does not age.

It is the intent of all temperature overload devices to be totally impartial to how heat is applied to the device, i.e. whether by conductance or radiation or a combination of the same and both the frequency and range of the oscillation of the temperature of the device during use. One of the reasons why fusible metal devices are widely used is the well known property of fusible metals to melt at a constant temperature. Thus, by utilizing the critical melt temperature of the device, that temperature must first be reached, and second be maintained sufficiently long enough for the device to melt. It is the intent of all who use fusible devices that the device trip as soon as the temperature is reached; and thus, fusible metal devices usually utilize small amounts of fusible metal and highly conductive supporting structures such that as soon as the temperature is released, the metal melts and the device trips. Thus, all fusible metal devices are designed such that once the critical temperature is reached; there are no mechanical structures that will prevent the fusible device from releasing and/or disconnecting. It is therefore highly desirable to provide a new and improved over-temp safety device that uses a fusible metal trigger that is not under stress, or, if under stress is supported so as to not subject the fusible metal to creep at temperatures below the critical temperature. It is therefore highly desirable to provide a new and improved over-temp safety device that uses a fusible metal trigger that is either not under stress, or, if under stress is supported so as to not subject the fusible metal to creep at temperatures below the critical temperature and that is impartial to how the heat is applied to the device. It is therefore highly desirable to provide a new and improved over-temp safety device that uses a fusible metal trigger that is either not under stress, or, if under stress the metal is supported so as to not subject the fusible metal to creep at temperatures below the critical temperature that is impartial to how the heat is applied to the device and that is impartial to the rate at which the temperature is applied to the fusible metal. It is therefore highly desirable to provide a new and improved over-temp safety device that uses a fusible metal trigger that is either not under stress, or, if under stress the metal is supported so as to not subject the fusible metal to creep at temperatures below the critical temperature that is impartial to how the heat is applied to the device and that is impartial to the rate at which the temperature is applied to the fusible metal and that releases and disconnects immediately upon the critical temperature being reached even when used at temperatures below the critical temperature for long periods of time.

Finally, it is highly desirable to provide a new and improved over-temp safety device that has all of the above features.

SUMMARY OF THE INVENTION

It is therefore an object of the invention to provide a new and improved over-temp safety device.

It is also an object of the invention to provide a new and improved over-temp safety device that does not age or become inoperative over time at temperatures below the critical temperature above which operating temperatures should not exceed.

It is also an object of the invention to provide a new and improved over-temp safety device that both releases as intended and also disconnects.

It is also an object of the invention to provide a new and improved over-temp safety device that will not creep and fail at temperatures below the critical temperature.

It is also an object of the invention to provide a new and improved over-temp safety device that is not part of an electrical circuit.

It is also an object of the invention to provide a new and improved over-temp safety device that is not dependent upon the adherence of fusible metal or the physical properties of the fusible metal or its electrical conductivity or resistance.

It is also an object of the invention to provide a new and improved over-temp safety device that does not utilize solid state electronic devices.

It is also an object of the invention to provide a new and improved over-temp safety device that is totally mechanical in nature.

It is also an object of the invention to provide a new and improved over-temp safety device that does not age.

It is also an object of the invention to provide a new and improved over-temp safety device that uses a fusible metal trigger that is not under stress, or, if under stress is supported so as to not subject the fusible metal to creep at temperatures below the critical temperature.

It is also an object of the invention to provide a new and improved over-temp safety device that uses a fusible metal trigger that is either not under stress, or, if under stress is supported so as to not subject the fusible metal to creep at temperatures below the critical temperature that is impartial to how the heat is applied to the device.

It is also an object of the invention to provide a new and improved over-temp safety device that uses a fusible metal trigger that is either not under stress, or, if under stress the metal is supported so as to not subject the fusible metal to creep at temperatures below the critical temperature that is impartial to how the heat is applied to the device and that is impartial to the rate at which the temperature is applied to the fusible metal.

It is also an object of the invention to provide a new and improved over-temp safety device that uses a fusible metal trigger that is either not under stress, or, if under stress the metal is supported so as to not subject the fusible metal to creep at temperatures below the critical temperature that is impartial to how the heat is applied to the device and that is impartial to the rate at which the temperature is applied to the fusible metal and that releases and disconnects immediately upon the critical temperature being reached but not before without aging.

It is finally an object of the invention to provide a new and improved over-temp safety device that has all of the above features.

In the broader aspects of the invention there is provided a new and improved over-temperature control device comprising a heat conductive surface, the temperature of which to be controlled below a selected critical temperature. A slug of fusible material at the critical temperature is positioned on the heat conductive surface. The slug has a hole therein and a headed bolt in the hole. The hole is less than the dimensions of the bolt head whereby the head cannot pass through the hole of the slug. A plate overlays the heat conductive surface with the slug therebetween. The plate has a hole therein through which the bolt head may pass. The plate hole and bolt and slug hole are coaxial. A compression spring urges the plate and the conductive surface together with the slug therebetween with less pressure than required to cause the fusible material of the slug to flow at temperatures below the critical temperature. The bolt is connected to a normally open switch by a spring in tension urging the bolt to pass through the holes in the plate and slug, and holds the switch in a closed condition with less force than required to overcome the compression spring and to separate the plate from the head conductive surface and less force than required to pull the bolt head through the hole in the slug in a non-melted condition. The spring in tension is released from tension and opens the switch when the bolt head is allowed to move through the hole of the slug and plate by the melting of the slug.

BRIEF DESCRIPTION OF THE DRAWING

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
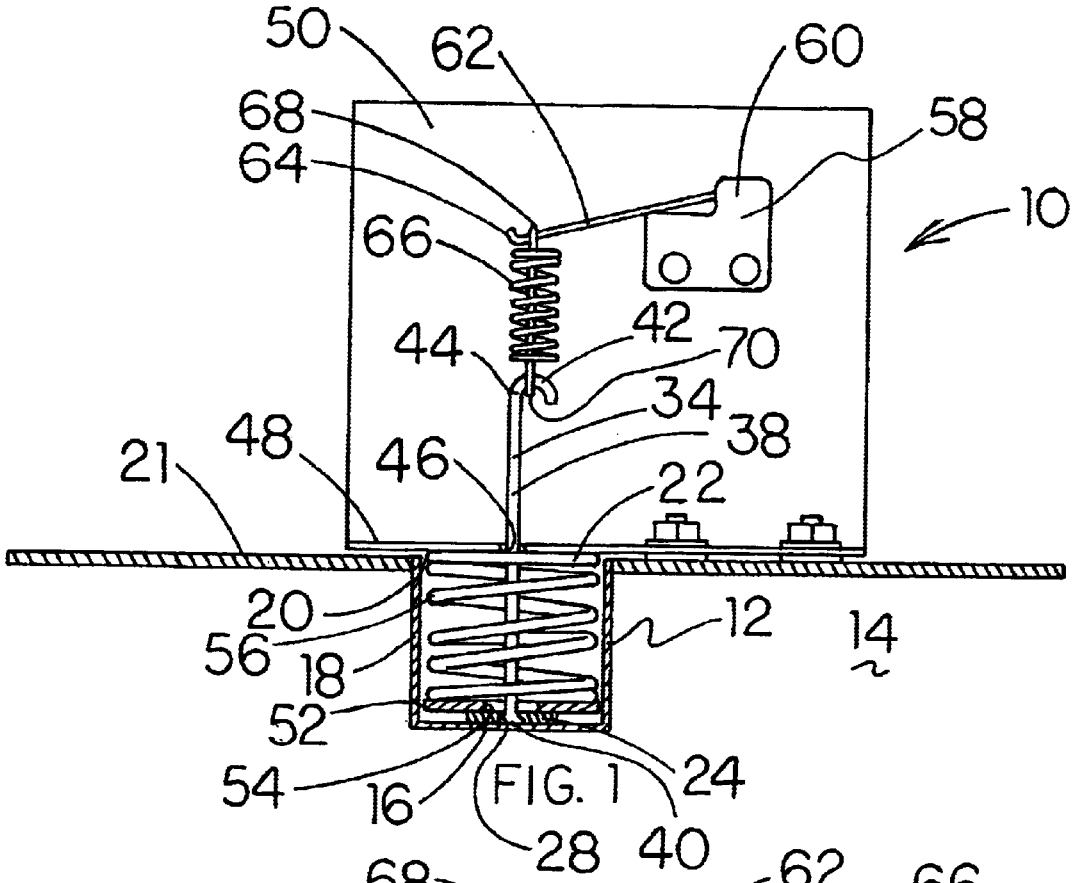
FIG. 1 is a partial cross-sectional view of the new and improved temperature overload device of the invention showing the limit switch in its normally closed position at temperatures below the critical temperature.
Figure 2:
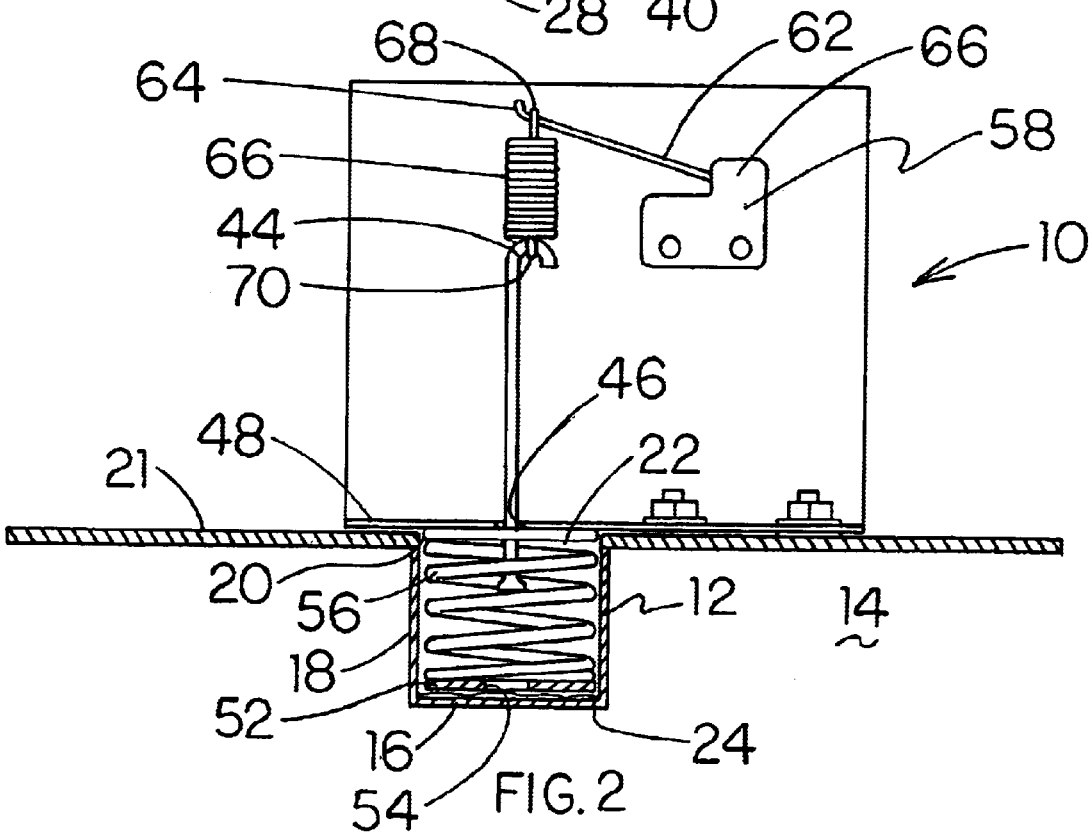
FIG. 2 is a fragmentary cross-sectional view like FIG. 1 of the new and improved overload temperature device of the invention showing the overload device tripped by the melting of the slug at temperatures above the critical temperature with the limit switch in its open condition.

The new and improved temperature overload device 10 of the invention is shown in FIG. 1 with the normally open limit switch 58 closed as would be the case at all temperatures below a desired critical overload temperature. FIG. 2 illustrates the temperature overload device 10 in an over-temperature condition with the limit switch in an open condition.

Temperature overload device 10 comprises a well 12 that extends into a vessel 14 that contains heated fluid that is desirably maintained below the desired overload temperature. Well 12 may be placed in the heated fluid within the vessel 14 containing the fluid (gas or liquid), or in a pressurized atmosphere of the fluid within the vessel 14. Vessel 14 may either be a pressurized vessel or a non-pressurized vessel, as the case may be. Well 12 has a bottom 16 and upstanding sides 18. Both bottom 16 and sides 18 are heated by the fluid within vessel 14. Well 12 is positioned coaxially of an opening 20 in the wall 21 of the vessel 14. Sides 18 are secured to the wall 21 by welding or other means. In specific embodiments, the sides 18 may engage the edge of the wall 21 defining the opening 20 as shown in FIG. 1, or the sides 18 may have a flange extending thereabout that engages a surface of wall 21 of vessel 14, or the edge defining the open top 22 of the well 12 may engage the wall 21 as shown in FIG. 2. In all cases, well 12 has an open top 22 that provides access to the interior of the well 12 from the exterior of the vessel 14 through opening 20.

A meltable disc 24 is placed on the bottom 16 of the well 12. Meltable disc 24 has a step diametered bore 26 therein.

Figure 3:
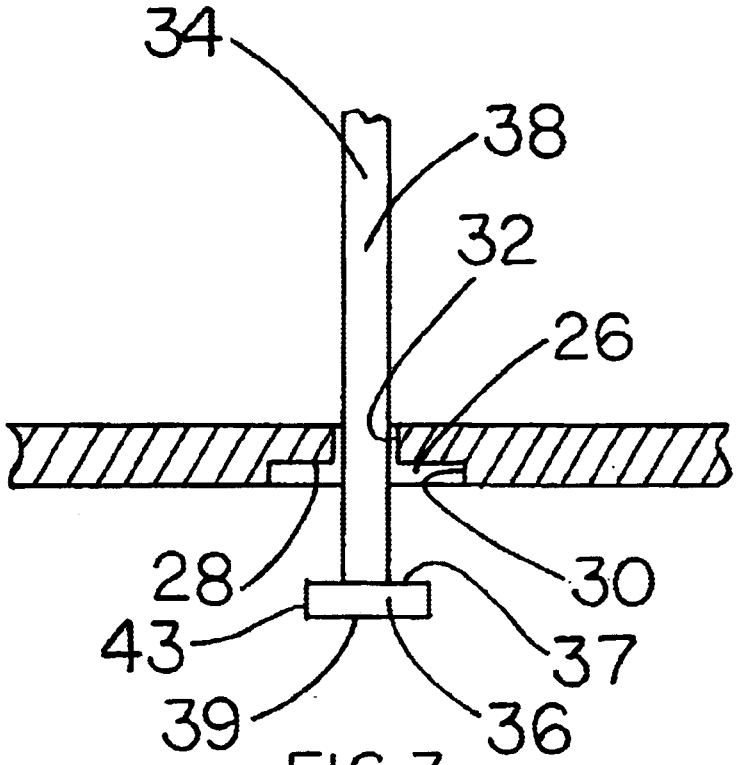
FIG. 3 is a fragmentary and enlarged view of the bolt and meltable disc showing one version of the step diametered opening therein.
Figure 4:
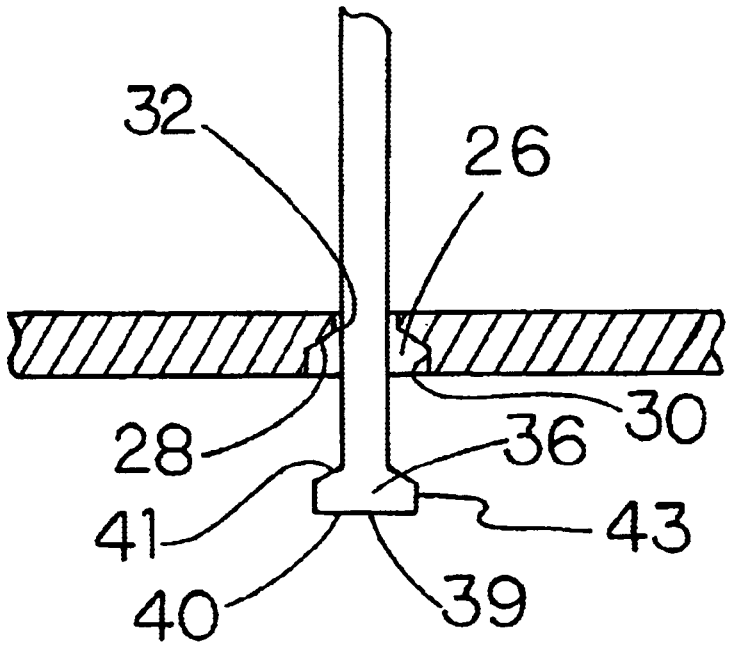
FIG. 4 is a fragmentary and enlarged view of the bolt and meltable disc showing another version of the step diametered opening therein.

Bore 26 is coaxial of the disc 24 and has the larger portion 30 adjacent the bottom 16 of well 12. Between the larger portion 30 and the smaller portion 32 is a step 28 that faces bottom 16 of well 12. Bolt 34 is positioned within step diametered bore 26. Bolt 34 has a head 36 that is positioned within the larger portion 30 of the step diametered bore 26 and a shank 38 that extends upwardly from the bottom 16 of the well 12 through the smaller portion 32 of the step diametered bore 26. Bolt head 36 may either be disc-shaped having oppositely facing planar surfaces 37, 39 as shown in FIG. 3 or may be shaped with a planar surface 39 facing oppositely of the shank 38 and a tapered head surface 41 communicating between the planar surface and the shank 38 as shown in the specific embodiment illustrated in FIG. 4. Both head shapes have a cylindrical surface 43 extending between surfaces 37, 39 in FIG. 3 and together with tapered surface 41 extending between surfaces 37, 39 in FIG. 4. The tapered surface 41, as will be mentioned hereinafter, functions to prevent the bolt head 36 from "hanging up" on other structure. In a specific embodiment, the step diametered bore 26 can be shaped as the bolt head 36 and bolt shank 38 are shaped as shown in FIGS. 3 and 4. In other embodiments, the step diametered bore 26 may have a larger portion 30 and a smaller portion 32 that are larger than the diameters of the bolt head 36 and bolt shank 38 as shown in FIG. 3. In all embodiments shown, portion 30 of bore 26 has an axial length sufficient to place bolt head surface 36 in the same plane as the interior surface of bottom 16 of well 12 and the surface of disc 24 superimposed thereon.

Bolt 34 has opposite ends 40, 42. Head 36 is at end 40. Shank 38 extends through an opening 46 in a plate 48 which overlays the exterior surface of the wall 21 of vessel 14. Plate 48 at least partially closes the open top 22 of the well 12. Opening 46, through which the shank 38 passes, is large enough to allow the shank 38 to slide within the opening 46 and generally coaxially centers shank 38 with the sides 18 and bottom 16 of the well 12. The opening 46 positions the meltable disc 24 generally coaxially of the bottom 16 of the well 12. In specific embodiments, plate 48 may be a flange of an L-shaped switch bracket 50 as shown in the drawings. In other embodiments, plate 48 may be the bottom of a housing enclosing the switch of the temperature overload device 10 of the invention. A housing is preferred in environments in which contamination of the limit switch or the like are concerns.

Overlaying the meltable disc 24 is a disc 52 that holds the meltable disc 24 on the bottom 16 of the well 12. Holding disc 52 has a size slightly smaller than bottom 16 of the well 12 and edges that are spaced from the sides 18 of the well 12. The contact between the edges of disc 52 and the sides 18 of well 12 maintain the disc within the well 12 generally coaxially. Disc 52 has a central opening 54 therein. Opening 54 is coaxial of the disc 52 and has a size smaller than the size of the meltable disc 24 but appreciably larger than the head 36 of bolt 34. Pressed between plate 48 and holding disc 52 is a spring 56 that holds the disc 52 tightly against the meltable disc 24 and thereby tightly sandwiching disc 24 between the holding disc 52 and the bottom 16 of well 12. Spring 56, like disc 52, has a diameter slightly smaller than the diameter of sides 18 such that sides 18 maintain spring 56 generally coaxially of well 12.

Secured to the switch bracket 50 or housing as the case may be is a limit switch 58. Limit switch 58 has a switch box 60 and a switch lever 62 as is conventional. Switch 58 is secured to the switch bracket 50 or housing in a position such that the distal end 64 of switch lever 62 is positioned coaxially of the opening 46, bolt shank 38, spring 56, disc or washer 52, disc or washer 24, bottom 16, and well sides 18. Limit switch 58 is a normally open switch. Extending between the distal end 64 and the hook 44 of the shank 38 of the bolt 34 is a spring 66. Spring 66 is shown to be a coiled spring having opposite distal ends 68, 70. Ends 68, 70 both have hook that is positioned on the distal end 64 of the switch lever 62 and engages the hook 44 of the shank 38 of the bolt 34, respectively. Spring 66 is in extension rather than compression and holds the switch lever 62 and the hook 44 of the shank 38 of the bolt 34 together. Spring 66 holds switch lever 62 in a closed switch position as shown in FIG. 1. Thus, so long as the meltable disc 24, bolt 34, and switch lever 62 are in the position shown in FIG. 1, the limit switch 58 is closed. Limit switch 58 is electrically connected to the heater of the vessel 14. Thus, when the switch lever 62 is in the position shown in FIG. 1, the heater will be on and the vessel 14 can be heated as desired.

In all embodiments, spring 66 applies less force to the bolt 34 and the switch lever 62 than the compression spring 56. Spring 56 is chosen to exert a force between the plate 48 and the well bottom 16 such that the meltable disc 24 is held on the bottom 16 and is generally immovable. Spring 66 does not have strength enough to lift the meltable disc 24 from the bottom 16 against the force exerted thereon by spring 56. Spring 66, however, does have sufficient force to move the bolt 38 through opening 54 of disc 52 and into the interior of spring 56 when meltable disc 24 is melted sufficiently for bolt head 38 to move through opening 54 of holding disc 52 as will be explained hereinafter, and the meltable disc 24 does not restrain bolt 38 from such motion. Spring 66 does not have sufficient force to bend switch lever 62 or deform the hook 44 of the bolt 34. In a specific embodiment, the spring constant of spring 56 is several pounds and the spring constant of the spring 66 is several ounces.

In a specific embodiment, limit switch 58 is a normally open, held closed switch. The spring 56 is a wound spring, the spring 66 is a wound round spring, the holding disc 52 is a round washer, well 12 is made of any steel, the vessel 14 is made of any steel, the plate 48 and switch bracket 50 are made of any metal, and the spring bracket 50 is secured to the vessel 14 by bolts 74 welded or otherwise fastened to the wall 21 of the vessel 14.

In this same specific embodiment, sides 18, and bottom 16 of well 12 are cylindrical and circular, respectively, in shape and have an interior diameter of about 1¼ inches. Spring 56 has a diameter of about 1⅛ inches. Holding disc 52 has a diameter of about 1⅛ inches and meltable disc 24 has a diameter of about 1 inch. The opening 54 of holding disc 52 has a diameter of about ¼ inch. Head 36 of bolt 34 has a diameter of about ⅜ inch. Bolt shank 38 has a diameter of about ⅛ inch and opening 46 within plate 48 has a diameter of about ¼ inch. While in the embodiment illustrated in this specific embodiment fully dimensioned circular geometry is utilized, there is no reason why different geometries could not be utilized, for example, in which the bottom 16 and sides 18 along with the other structure that is circular, are square or hexagonal or of other geometric shapes. It is well within the skill of persons skilled in the art to which this invention pertains to change the geometry of this structure from circular geometry to other geometries in a manner not to sacrifice the function of the temperature overload device 10 of the invention.

In operation, the limit switch 58 is normally closed as shown in FIG. 1. Vessel 14 can be heated as desired. The heater is controlled by a thermostat to maintain the temperature of the fluid within the vessel 14 below the desired temperature. The meltable disc 24 is a cast disc of the shape above described of fusible material having a melting point at the desired temperature. The material from which the meltable disc is cast is of any one of a number of fusible materials chosen from the group of fusible materials consisting of solder, tin, lead, and any mixture thereof. Because of the bore 26 of bolt 34 being placed therein, the one surface of the meltable disc 24 is fully contiguous and overlays and is in contact with the bottom 16 of well 12 thereby providing good heat transfer between bottom 16 and disc 24. Essentially in operation, the disc 24 will be of the same temperature as the bottom 16 of well 12.

If ever the temperature of bottom 16 of well 12 exceeds the desired temperature, disc 24 will soften and/or melt to a degree such that the spring 66 pulls the bolt head 34 through the opening 54 of the holding disc 52 into the interior of the spring 56 thereby opening the limit switch and preventing the heater of the fluid within the vessel 14 from operating. In this condition, the temperature overload device 10 needs servicing prior to the heater of the vessel 14 operating again. Service would include removing the spring 56 from the well 12, removing the holding disc 52 from the well 12, removing the melted disc 24 and replacing the melted disc 52 with a new disc 52 and reassembling the device as shown in FIG. 1.

In the specific embodiment above described, bolt head 36 has a tapered surface extending from a planar surface to the shank 38. This tapered surface prevents the bolt from getting "hung up" on the holding disc 52 or spring 56. For example, if bolt 34 becomes out of a coaxial position with the opening 54 of the disc 52 and engages the disc 52 at the periphery of the opening 54, the tapered surface will prevent the head 36 from being "hung up" on the holding disc 52 and allow the head 36 to pass through the opening 54 into the interior of the spring 56 as desired.

The invention provides a new and improved over-temp safety device. The over-temp safety device does not age or become inoperative over time at temperatures below a desired temperature. The new and improved over-temp safety device of the invention both releases as intended and also disconnects the heater of the apparatus to which it is connected. The new and improved over-temp safety device will not creep or fail at temperatures below the desired temperature. The new and improved over-temp safety device utilizes a fusible device that is not part of an electrical circuit and is not dependent upon the adherence of fusible metal or the physical properties of the fusible metal or its electrical conductivity or resistance. The new and improved over-temp safety device does not utilize solid state electronic devices and is totally mechanical in nature. The new and improved over-temp safety device uses a fusible metal trigger that is not under stress, and is fully supported such that it is not subject to creep at temperatures below the critical temperature. The new and improved over-temp safety device of the invention provides good heat transfer to the fusible metal device at all operating temperatures.

While the specific embodiment of the invention has been shown and described herein for. purposes of illustration, the protection offered by any patent which may issue upon this application is not strictly limited to the disclosed embodiment; but rather extends to all structures and arrangements which fall fairly within the scope of the claims which are appended hereto:

What is claimed is:

1. An over temperature control device comprising a heat conductive surface the temperature of which is desirably controlled below a selected critical temperature, a slug of fusible material having a melting point at said critical temperature on said heat conductive surface, said slug having a hole therein, a bolt in said hole, said hole having a diameter less than the size of the head of said bolt whereby said head cannot pass through said hole in said slug, a plate overlaying said conductive surface with said slug therebetween, said plate having a hole therein, said plate hole and said slug hole being coaxial with said bolt, said plate hole having a diameter which is greater than the size of said bolt head whereby said bolt head may pass through said plate hole when released by said slug, a compression spring urging said plate and said conductive surface together with said slug therebetween with less force than necessary to cause said fusible material to flow or creep, said bolt being connected to a switch by an extension spring, said extension spring urging said head through said slug and plate holes and holding said switch in a closed position with less force than that necessary to either to cause said fusible material to flow or creep or necessary to allow said plate to move away from said conductive surface against the urging of said compression spring, whereby said extension spring upon the melting of said slug pulls said bolt through said plate hole and opens said switch.

2. The over temperature control device of claim 1 wherein said conductive surface is the bottom of a well extending into a vessel containing a heated fluid.

3. The over temperature control device of claim 1 wherein said fusible material is a commercially available fusible alloy.

4. The over temperature control device of claim 1 wherein said slug is a washer molded of said fusible material.

5. The over temperature control device of claim 4 wherein said slug hole is countersunk to accommodate said bolt head and to allow said slug to have surface to surface contact with said heat conductive surface over a major portion of its exterior surface.

6. The over temperature control device of claim 5 wherein said surface to surface contact is sufficient to maintain said slug at the temperature of said heat conductive surface.

7. The over temperature control device of claim 1 wherein the heat conductive surface and plate maintain said slug in compression.

8. The over temperature control device of claim 7 wherein said heat conductive surface and said plate structurally support substantially all of said slug.

9. The over temperature control of device of claim 1 wherein said heat conductive surface and said plate structurally support said slug except in the area of said plate hole.

10. The over temperature control device of claim 1 wherein said compression spring is a coil spring.

11. The over temperature control device of claim 2 wherein said well is a cylindrical well and said compression spring is a coil spring, said well maintaining said spring and said plate coaxial.

12. The over temperature control device of claim 1 further comprising a switch support wherein said bolt passes through a hole in said switch support, said switch support hole maintaining said bolt coaxial with both said springs.

13. The over temperature control device of claim 1 wherein said extension spring is a coil spring having a spring constant less than said compression spring.

14. The over temperature control device of claim 1 wherein said extension spring places a force on said slug less than any creep strength of said fusible material.

15. The over temperature control device of claim 1 wherein said compression spring places a force on said slug less than any creep strength of said fusible material in compression.

16. The over temperature control device of claim 1 wherein said switch is a conventional normally open limit switch.

17. The over temperature control device of claim 12 wherein the difference between the diameter of said bolt and the diameter of said hole in said switch support is less than the difference between the diameter of said bolt head and the diameter of said plate hole.

18. The over temperature control device of claim 2 wherein the difference in diameter between said bolt head and said plate hole is greater than the difference in diameter between said well and said plate.

* * * * *